United States Patent [19]

Ufferfilge

[11] 4,035,303

[45] July 12, 1977

[54] OPEN MESH FILTER ELEMENT

[75] Inventor: Roger K. Ufferfilge, Cary, Ill.

[73] Assignee: Seaquist Valve Company, Cary, Ill.

[21] Appl. No.: 649,906

[22] Filed: Jan. 16, 1976

[51] Int. Cl.[2] ..... B01D 25/04

[52] U.S. Cl. ..... 210/316; 210/339; 210/432; 222/189

[58] Field of Search ..... 55/417; 137/550; 210/316, 317, 336, 339, 416 R, 429, 430, 431, 432, 445, 455, 233; 222/189

[56] References Cited

U.S. PATENT DOCUMENTS

| | | | |
|---|---|---|---|
| 1,185,309 | 5/1916 | Haeseler | 137/550 |
| 2,120,297 | 6/1938 | Reinecke | 222/189 X |
| 2,288,715 | 7/1942 | Karrer et al. | 55/417 X |
| 2,741,319 | 4/1956 | Mickelsen | 222/189 X |
| 2,774,628 | 12/1956 | Engstrum | 222/189 X |
| 3,209,954 | 10/1965 | Webster | 210/431 X |
| 3,319,829 | 5/1967 | Sentz | 222/189 X |
| 3,471,019 | 10/1969 | Trasen et al. | 210/445 X |
| 3,970,084 | 7/1976 | Raines et al. | 210/445 X |
| 3,970,219 | 7/1976 | Spitzer et al. | 222/189 X |

FOREIGN PATENT DOCUMENTS

| | | | |
|---|---|---|---|
| 373,157 | 7/1939 | Italy | 210/316 |
| 185,807 | 9/1922 | United Kingdom | 210/445 |

*Primary Examiner*—Wilbur L. Bascomb, Jr.
*Assistant Examiner*—Robert H. Spitzer
*Attorney, Agent, or Firm*—Stefan M. Stein; Robert F. Frijouf

[57] ABSTRACT

A valve structure for a fluid dispenser primarily of the type known in the art as an aerosol dispenser incorporating a filter assembly comprising one or more filter elements each formed from an apertured, open mesh material of nylon or like synthetic fiber. At least one of the filter elements is mounted on a filter housing in the form of an auxiliary valve body attached to the primary valve body of the valve structure wherein the path of fluid flow is established from the interior of the dispenser to the valve chamber and the one or more filter elements are disposed in interruptive disposition relative to the path of fluid flow so as to cause filtering of any undesirable particles from the product or propellant as the product is being dispensed.

16 Claims, 8 Drawing Figures

OPEN MESH FILTER ELEMENT

BACKGROUND OF THE INVENTION

1. Field of the Invention

This invention relates to a filter assembly for a valve structure utilized with a fluid dispenser wherein the filter element or elements are formed from an open mesh material specifically dimensioned and configured to be positioned in interruptive relation relative to the flow of fluid from the interior of the dispenser through the valve structure as it is being dispensed so as to accomplish filtering of the product being dispensed without causing clogging, back pressure or the like.

2. Description of the Prior Art

Fluid dispensers, including aerosol type dispensers have been utilized in the industry for many years and have become extremely popular with the general public. Generally, such fluid dispensers including a valving means mounted in the upper portion of the dispenser and in fluid communication with the product and propellant within the dispenser. The valving structure itself is specifically designed and utilized to control the discharge of product therefrom. Operation of generally conventional valve means includes the valving structure being commonly biased into a normally selected position whereby inadvertent discharge of the product from the valve means is prevented. A dip tube or like conduit generally extends in fluid communicating relation between the interior of the valve structure and the fluid product housed within the dispenser.

Particularly with aerosol dispensings, a gaseous propellant normally occupies what is referred to as the head space or the area between the fluid product itself, generally resting at the bottom of the dispenser and the top of the dispenser on which the valve structure is mounted. When the container has an adequate amount of product therein, the product is normally located below the head space as it is being dispensed. Upon the reduction of the amount of product within the dispenser, the head space increases, causing some of the propellant to vaporize. With the wide popular acceptance enjoyed by the fluid dispensing industry, and in particular the aerosol dispensing segment of this industry, there has been an increasing demand for availability of a wide variety of products being dispensed from fluid type dispensers of the category being discussed. Accordingly, with the advent of various types of products being dispensed, the operating characteristics of the valve structure associated with such dispensers have had to become increasingly more efficient.

For example, filtering of various fluid products has become a common problem associated with the industry. It is frequently desirable to provide a valve structure which incorporates a filtering element or feature to avoid clogging and interference with the dispersing of a given liquid product. Clogging often occurs because of particles blocking the terminal orifice or any other generally restricted orifice disposed along the path of fluid flow along which the liquid product travels as it leaves the interior of the dispenser. A number of such filtering elements, while existing in the prior art, are generally over complex in design and function or inefficient in operation. Therefore, the industry has found that in order to provide an operable filtering means associated with a valve structure for aerosol dispensers or like fluid dispensers, the industry has had to overcome either relatively great expense in the manufacture of such filtering elements and associated valve structure or provide a design which is sufficiently simple yet capable of efficient and reliable operation.

Accordingly, it can be seen that there is a great need in the dispensing industry for a valve structure capable of providing other operable characteristics required in the dispensing industry while at the same time providing a filtering feature of the product as it passes through the valve structure and issues from the dispenser.

SUMMARY OF THE INVENTION

This invention relates to a valve structure of the type used with a fluid dispenser. In particular the valve structure of the present invention is capable of being used in combination with an aerosol dispenser wherein a pressurized propellant is used to force product through an extended dip tube of substantially conventional design and into the valve structure.

More particularly, the valve structure of the present invention comprises a valve housing having a chamber defined on its interior. The housing and chamber are specifically designed and configured to be used in combination with other substantially conventional valve elements such as a valve stem disposed in fluid communication with the valve chamber and a valve sealing gasket or sealing means disposed to seal off the valve stem from the interior of the container until properly depressed or oriented so as to establish this fluid communication. A valve stem sealer is disposed on the interior of the valve chamber and cooperates with a biasing means in the form of a spring or the like forcing the valve stem sealer into engagement with the sealing means and thereby normally biasing the valve stem into sealed off engagement relative to the interior of the valve chamber.

A filtering means comprising at least one filter element is formed from an apertured, open mesh material of nylon or like synthetic fiber. The filter means is disposed in flow interruptive relation relative to the path of fluid flow travelled by the fluid product from the interior of the dispenser to the interior of the valve chamber. Accordingly, the valve body and the valve chamber are specifically designed and configured to at least partially define the path of fluid flow which will be described in greater detail hereinafter.

One embodiment of the present invention comprises the filtering means being welded or otherwise bonded to the exterior of the valve body upstream of a restricted orifice which defines fluid communication between the valve chamber and the exterior of the valve body. In this particular disposition, any undesirable particles may be filtered from the fluid or liquid propellant as it travels into the valve chamber along the path of fluid flow.

The valve structure of the present invention further comprises a filter holder means which may be in the form of a filter housing. The filter housing may comprise an auxiliary valve body which is designed and configured essentially to correspond to the original or primary valve body. The auxiliary valve body is attached to the exterior of the primary valve body and is disposed in fluid communication therewith. A filter chamber is formed on the interior of the auxiliary valve body and the filter means in the form of the open mesh material is mounted or otherwise secured therein. The disposition of the filter means can be immediately contiguous to the restricted orifice in the primary valve body. Alternately, it can be arranged in spaced relation to the restricted orifice while still being maintained within the filter chamber of the auxiliary valve body.

The valve chamber may be integrally formed as an extension of the primary valve body and disposed in fluid communication therewith. With this embodiment an alternate structure may also include the use of a plug member specifically configured to have a peripheral edge portion serving to lock the filter means of the present invention into secure engagement within the filter chamber.

Yet another embodiment of the present invention comprises the use of at least a first filter element and a second filter element where both filter elements are formed from an apertured, open mesh material. In this particular embodiment the filter housing is utilized wherein the first and second filter elements are disposed on the housing and within its interior in predetermined, spaced relation to one another. Their disposition is such as to be aligned in interruptive position relative to the path of fluid flow of the liquid propellant. Accordingly, in this embodiment, a double filtering feature is accomplished in that one of the first or second filter elements is disposed adjacent the terminal end of the auxiliary valve body on either its interior or exterior and the other of the first or second filter elements is disposed definitely within the interior of the auxiliary valve body in adjacent or contiguous relation to the restricted orifice of the primary valve body.

Yet another embodiment of the present invention includes the filter means comprising a plurality of filter elements integrally formed on the exterior surface of the valve body and disposed in fluid communication between the interior of the valve body or valve chamber and the exterior of the valve body. Yet another embodiment of the present invention, the structure of which was described above, the formation the the filter means and its attachment to the valve body is done in an advantageous manner which aids in assembly and reliability of function of the end product. More specifically, a plug means has one end thereof specifically configured into a peripheral "cutting" edge which is shaped to correspond to the desired shape of the filter means. This plug is positioned in substantially aligned relation with the filter chamber which may be integrally formed on the valve body. A continuous web or sheet, etc., of the open mesh filtering material may be travelling and/or fixedly positioned, periodically, between the plug and the aligned filter cavity of the body. Movement of the plug into successive engagement with the filtering means and the filter chamber causes severing of the filtering means from the open mesh material and corresponding shaping thereof as the plug passes into locked relationship with the filter chamber.

The assembled filter means is then further joined with the remaining structural elements mounted on the valve structure in any applicable manner.

This invention accordingly comprises an article of manufacture possessing the features, properties and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION

Figure 1:
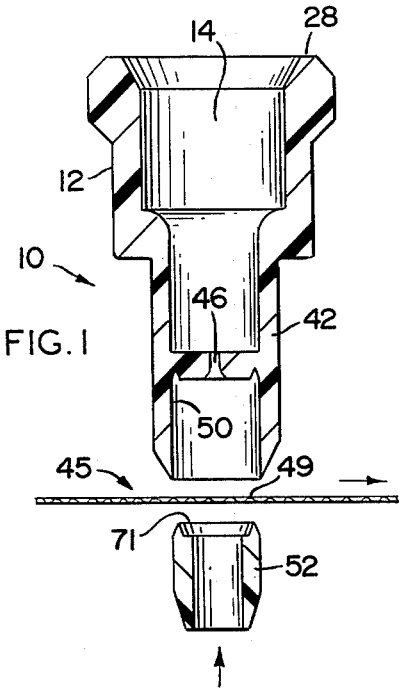
FIG. 1 is a sectional view showing one embodiment of the present invention utilizing a plug means for forming and mounting the filtering element on the valve body.
Figure 2:
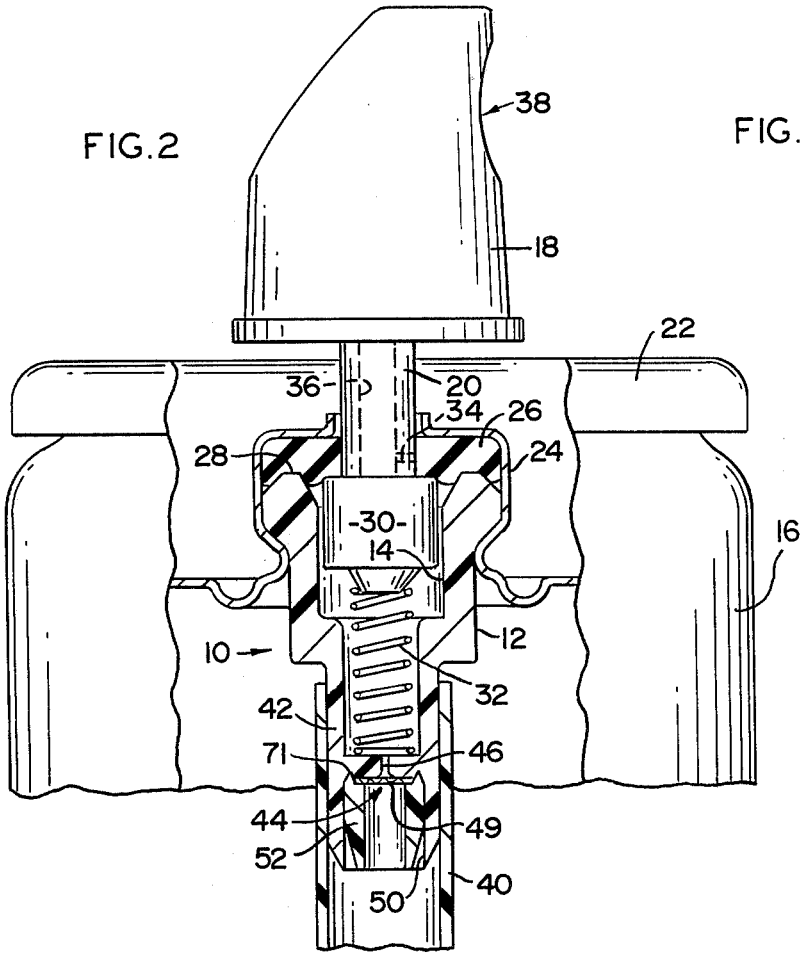
FIG. 2 is a partial sectional view showing the valve structure of the subject invention with the filter means mounted thereon in assembled form.

As shown in FIGS. 1 and 2, the present invention is directed to a valve structure generally indicated as 10 including a valve body 12 having a valve chamber 14 defined within its interior.

With reference to FIG. 2, the valve structure 10 is designed to be used in cooperation with a fluid dispenser 16 which may be of the aerosol type. Accordingly, other, substantially conventional structure elements may be used with the valve structure of the present invention to accomplish its operability. Therefore, a valve button 18 may be mounted on a valve stem 20 wherein the valve body 12 is attached to valve cap 22 attached to the upper portion of the dispenser 16 and serving to seal the interior from the exterior thereof. A central turret 24 is mounted in substantially surrounding relation to the valve body 12. A sealing means in the form of a sealing washer 26 is formed on the upper portion thereof and engages the upper surface 28 of the valve body 12. A valve stem sealer 30 is integrally attached to the lower portion of the valve stem and is biased into sealing engagement with the sealing means 26 by a biasing spring 32. An orifice indicated in broken lines as 34 serves to communicate with channel means 36 within the interior of the valve stem 20 to establish fluid communication between the interior of the valve housing 12 or valve chamber 14 and the valve stem 20 and terminal orifice of button 18 generally indicated as 38. This of course, occurs upon depression or intended movement of the valve button 18. In addition to the above, the conventional dip tube 40 may be attached to the valve body and more particularly the dip tube tail 42 which serves as an integral extension of the valve body 12.

An important feature of the present invention comprises the provision of a filtering means generally indicated as 44 comprising an apertured, open mesh material of sufficient dimension and configuration to allow passage therethrough of product and the desired amount of accompanying propellant while at the same time eliminating the build up of any harmful back pressure. The particular size of the open mesh material and/or the apertures defining the open mesh may be predetermined depending upon the composition of the product and/or propellant being utilized within the dispenser 16.

The path along which the fluid product travels as it exits from the interior of the dispenser 16, through the dip tube 40 and through the valve body 12 into the valve chamber generally defined as what may be referred to as a path of fluid flow. The filtering means 44 in the embodiment to be described hereinafter is disposed in interruptive relation relative to the path of fluid flow so as to "filter" all product and propellant passing along the path of fluid flow from the interior of the dispenser 16. Furthermore, the filtering means, as set forth in the various embodiments is preferably located upstream of the valve chamber 14 and of a restricted orifice means 46 disposed in fluid communication between valve chamber 14 and the exterior of valve body 12. Again, dependent upon the particular application for which the valve structure of the present invention is utilized, the configuration of the restricted orifice 46 may be somewhat different and its restriction may vary or essentially be non-existent. For this reason, the restricted orifice can be generally represented as an orifice means to establish fluid intercommunicating relation between the interior and exterior of the valve body 12. Turning to the embodiments shown in FIG. 1, the filtering means 44 generally comprises a first filter element 49 disposed contiguous to orifice means 46 and within filter chamber 50. A plug means 52 is frictionally engaged or otherwise fixedly mounted within the chamber 50 in locking engagement relative to the filter element 49.

Figure 6:
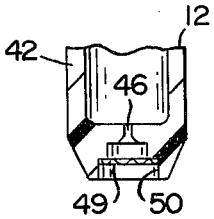
FIG. 6 is a sectional view of one embodiment of the present invention showing a specific disposition of the filter means.

FIG. 6 similarly shows a first filter element 49 being located generally in what may be referred to as the filter chamber 50 which is integrally formed on the valve body 12 and more particularly on the dip tube tail 42 or extension of the valve body.

Figure 8:
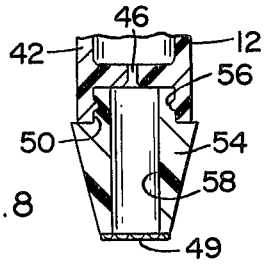
FIG. 8 is a modification of the embodiment of FIG. 1 wherein the plug element is attached within the valve chamber of the valve body and the filter means is shown in spaced relation to the restricted orifice of the valve body.

Similarly, the embodiment of FIG. 8 also incorporates the use of a plug means 54 snap fitted by connector 56 or otherwise bonded to the interior of the dip tube tail or extension 42 on the interior of the filter chamber 50. A central channel 58 serves to establish fluid communication between the exterior of the valve body 12 and the interior of the valve body through a first filter element 49. Again, the filter element 49 is an apertured, open mesh material of predetermined configuration and dimensions.

Figure 3:
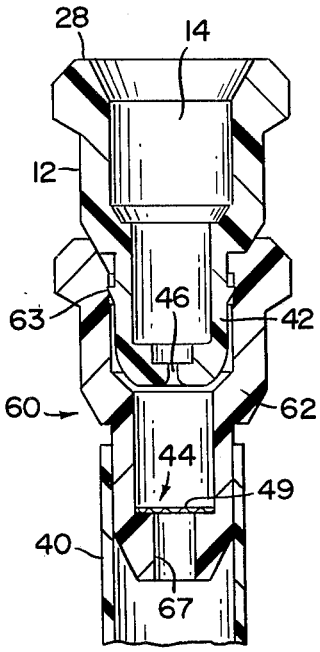
FIG. 3 is a sectional view of yet another embodiment of the present invention wherein the filter holder means is shown attached to the valve body.
Figure 4:
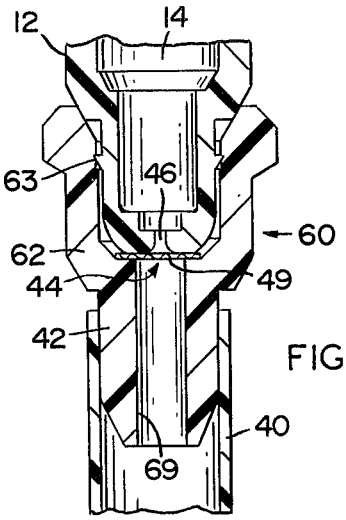
FIG. 4 is a sectional view of yet another embodiment of the present invention wherein the filter means is disposed substantially contiguous to the filter body.
Figure 5:
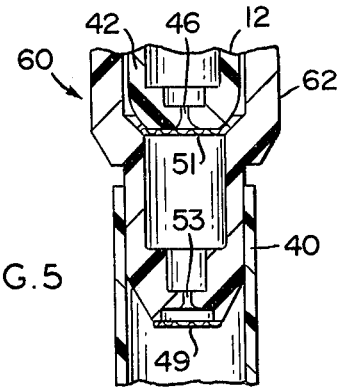
FIG. 5 is yet another embodiment of the present invention wherein the filter means comprises a plurality of filter elements.

The embodiment shown in FIGS. 3, 4 and 5 comprise a filter holder means generally indicated as 60. The holder means may comprise a filter housing which, if applicable, may be substantially configured to that of the valve housing 12. By virtue of this configuration the extension or dip tube tail portion 42 may fit within the interior of the auxiliary housing 62 and be secured therein by a proper connector means 63. This connector means may comprise an annular ridge or applicably shaped projection which may engage the interior wall portion of the auxiliary housing 62 as clearly shown in FIGS. 3 and 4. Turning to the embodiment shown in FIG. 3, the filter means comprises a first filter element 49 secured in by welding or proper bonding the interior of auxiliary body 60 in spaced relation to aperture 46. An entrance channel 67 is disposed in fluid communication between the interior of the dip tube, or the exterior of the auxiliary body 62 and the interior of the body 62 so as to establish the path of fluid flow from the interior of the dispenser 60 into the valve chamber 14.

Alternately, the embodiment of FIG. 4 shows the filter element 49 being disposed in substantially contiguous relation to the orifice means 46 wherein fluid flow in the interior of dip tube 40 is established by elongated channel 69 disposed substantially similar to that of channel 67 with reference to the discussion of the embodiment of FIG. 3. Turning to the embodiment of FIG. 5, the filter means comprises a first filter element 49 and a second filter element 51 disposed in spaced relation to one another and each mounted on the auxiliary body 60. More specifically, the first filter element 49 is welded, or sonically welded bonded or otherwise applicably fixed in filtering relation relative to orifice means 53 formed in the auxiliary body 60. The second filter element 51 is disposed in spaced relation to the first filter element 49 but along the flow path and in substantially aligned relation to the first filter element 49 as shown. Accordingly, a second filter element 51 is disposed in substantially contiguous relation to the orifice means 46 so as to clearly establish the filtering means being disposed in interruptive relation relative to the established path of fluid flow from the interior of dispenser 16 to the valve chamber 14. In this particular embodiment, both the first and second filter elements comprise an apertured, open mesh material of predetermined size and configuration. It is further important to note that the size of the respective first and second filter elements may differ in order to accomplish a more efficient successive or stage-like filtering effect of the fluid product and/or propellant passing along the path of fluid flow from the interior of dispenser 16.

Figure 7:
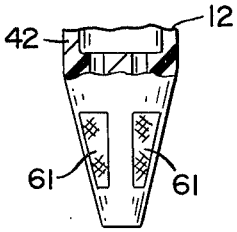
FIG. 7 is yet another embodiment of the present invention wherein the filter means is shown as being integrally formed on the exterior surface of the valve body.

Yet another embodiment of the present invention is shown in FIG. 7 and comprises a plurality of filter elements 61 disposed about the outer peripheral surface of extension 42 of valve body 12 wherein the filter element 61 are integrally formed or attached to the valve body in interruptive relation relative to the path of fluid flow as previously discussed. Again, each of the filter elements 61 comprises an apertured, open mesh material of predetermined design and configuration.

It has been found through experimentation that the open mesh material may be adequately formed from a synthetic fiber such as nylon or like synthetic fiber wherein the particular size of the apertures defining the open mesh may be varied dependent upon the particular application to which the valve structure of the present invention is directed.

With reference to FIG. 1, a process for forming the filter means and for assemblying a filter element within the valve chamber 50 is depicted. More specifically, plug means 52 may have its upper peripheral portion 71 formed into a substantially cutting edge configured to correspond to the outer configuration of the filter element 49. Forced movement of the plug means into engagement with filter material generally indicated as 45 passing between the plug means 52 and the valve body 12 causes successive engagement with the filter material 45 and eventually the filter cavity 50. This successive, forced engagement and the fact that the peripheral edge portion 71 serves as a cutting edge allows severing of the filter element 49 in its predetermined shape from the rest of the material 45. The firm positioning of the plug means 52 in chamber 50 causes the secure engagement of both the plug means 52 and the filter element 49 within the chamber 50.

It will thus be seen that the objects made apparent from the preceding description are efficiently attained, and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features herein described, and all statements of the scope of the invention which, as a matter of language, might be said to fall therebetween.

Now that the invention has been described,

What is claimed is:

1. A valve structure of the type primarily designed for use with a sealing washer and a stem sealer having a stem internal orifice and with a fluid dispenser, said valve structure comprising: an integral valve body having a sealing surface in proximity to one end of said valve body adapted for sealing with the sealing washer; said valve body having a valve chamber defined within said valve body adjacent said sealing surface for receiving the stem sealer, said integral valve body including orifice means disposed in fluid communicating relation between said valve chamber and the exterior of the other end of said valve body; said valve body configured to at least partially define a path of fluid flow, whereby fluid within the dispenser flows along said orifice means and through said valve chamber into the stem orifice upon the stem sealer being displaced relative to the sealing washer; a filter chamber integrally formed in said valve body adjacent said other end of said valve body; filter means formed from an apertured, open mesh material fixedly secured within said filter chamber of said integral valve body and disposed in interruptive relation to said path of fluid flow upstream of said orifice means, whereby fluid passing through said valve chamber from said dispenser passes through said filter means.

2. A valve structure as in claim 1 wherein said orifice means has a substantially smaller cross-sectional area than said valve chamber for restricting the flow of the fluid.

3. A valve structure as in claim 1 wherein said open mesh material is welded to said valve body in fixed relation to said path of fluid flow.

4. A valve structure as in claim 3 wherein said open mesh material is sonically welded to said valve body in interruptive relation to said path of fluid flow.

5. A valve structure as in claim 1 further comprising filter holder means including a filter housing connectable to said valve body, said filter housing disposed to at least partially define said path of fluid flow and further disposed in fluid communication with said valve chamber, said filter means connected to said filter housing to interrupt the flow of the fluid.

6. A valve structure as in claim 5 wherein said filter means comprises a first filter and a second filter element each formed from an apertured, open mesh filter material, both said first and second filter elements on said filter housing in substantially aligned, spaced relation to one another in interruptive relation to said path of fluid flow, whereby fluid passing along said path of fluid flow from the dispenser interior to said valve chamber passes through both said first and second filter means.

7. A valve structure as in claim 6 wherein said first filter element is fixedly attached to the exterior of said filter housing and said second filter element is disposed on the interior of said housing in aligned, spaced relation to said first filter element along said path of fluid flow.

8. A valve structure as in claim 1 wherein said filter housing comprises an auxiliary body adapted to be attached to said valve body in aligned fluid communicating relation.

9. A valve structure as in claim 1 wherein said open mesh filter material is secured within said filter chamber in contiguous relation to said orifice means.

10. A valve structure as in claim 1 wherein said open mesh filter material is fixedly mounted within said filter chamber in spaced apart relation to said orifice means.

11. A valve structure as in claim 1, further comprising filter holding means including a plug element connected to said valve body and in direct, fixed engagement with said filter means.

12. A valve structure as in claim 11 wherein said plug element is correspondingly configured to be mounted within said chamber in locking engagement with said filter means.

13. A valve structure as in claim 11 wherein said plug means comprises a peripheral edge portion correspondingly configured and dimensioned to said filter chamber, said peripheral edge portion disposed in filter locking engagement with said filter means and said filter chamber.

14. A valve structure as in claim 11 wherein said filter means is fixedly connected to one extremity of said plug, channel means extending along the interior of said plug, said channel means at least partially defining said path of fluid flow and disposed in communicating relation with said valve chamber.

15. A valve structure as in claim 1 wherein said filter means comprises a plurality of filter elements each disposed in spaced relation to one another and integrally formed about the outer peripheral surface of said valve body.

16. A valve structure as set forth in claim 1, wherein said orifice means includes restricted orifice means having a cross-sectional area substantially less than said filter chamber means whereby the filtering area is substantially greater than the cross-sectional area of said restricted orifice means.

* * * * *

UNITED STATES PATENT OFFICE

CERTIFICATE OF CORRECTION

Patent No. 4,035,303 Dated July 12, 1977

Inventor(s) Roger K. Ufferfilge

It is certified that error appears in the above-identified patent and that said Letters Patent are hereby corrected as shown below:

Column 1, line 19, "including" should read --include--.
line 26, "selected" should read --sealed--.

Column 2, line 20, after "a" second occurrence insert --valve--.

Column 8, line 35, after "said" to read --filter--.

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*